United States Patent [19]

Baram

[11] 3,997,103

[45] Dec. 14, 1976

[54] PATH OF CONVEYANCE WITH MEMBRANE

[75] Inventor: Martin Baram, Brondby Strand, Denmark

[73] Assignee: Escher Wyss Limited, Zurich, Switzerland

[22] Filed: Aug. 26, 1975

[21] Appl. No.: 607,830

[30] Foreign Application Priority Data

Sept. 2, 1974 Switzerland ..... 11887/74

[52] U.S. Cl. ..... 233/3; 233/46

[51] Int. Cl.[2] ..... B04B 1/00; B04B 11/04

[58] Field of Search ..... 233/3, 4, 5, 6, 27, 233/28, 9, 46; 198/1

[56] References Cited

UNITED STATES PATENTS

| | | | |
|---|---|---|---|
| 1,011,078 | 12/1911 | Peck | 233/9 |
| 2,161,476 | 6/1939 | Leja | 233/3 |
| 2,179,807 | 11/1939 | Asmussen | 233/5 |
| 3,297,244 | 1/1967 | Hein | 233/27 |
| 3,771,715 | 11/1973 | Baram | 233/3 |

*Primary Examiner*—George H. Krizmanich
*Attorney, Agent, or Firm*—Robert A. Ostmann

[57] ABSTRACT

A path of conveyance is provided with a membrane for transporting a material over a length section of the path towards a discharge end; the membrane demarcates from the material a pressure medium chamber situated at the bottom of the path, extending transversely to the direction of conveying and being adapted to be acted upon by means of a pressure medium; as viewed in a longitudinal section through the path the membrane comprises two portions of which the first portion situated relatively near the discharge end of the path is reinforced in the longitudinal direction, and the second portion is left flexible; the edge of the reinforced first portion which is situated relatively near the discharge end of the path is also left flexible; at least the second, flexible portion of the membrane is briged by means of a covering skin.

16 Claims, 7 Drawing Figures

Fig.1
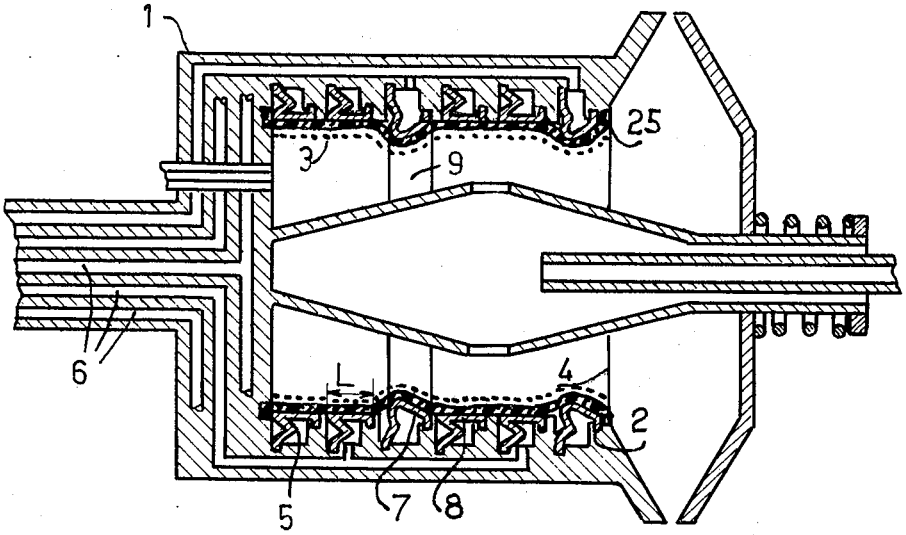
Fig. 2
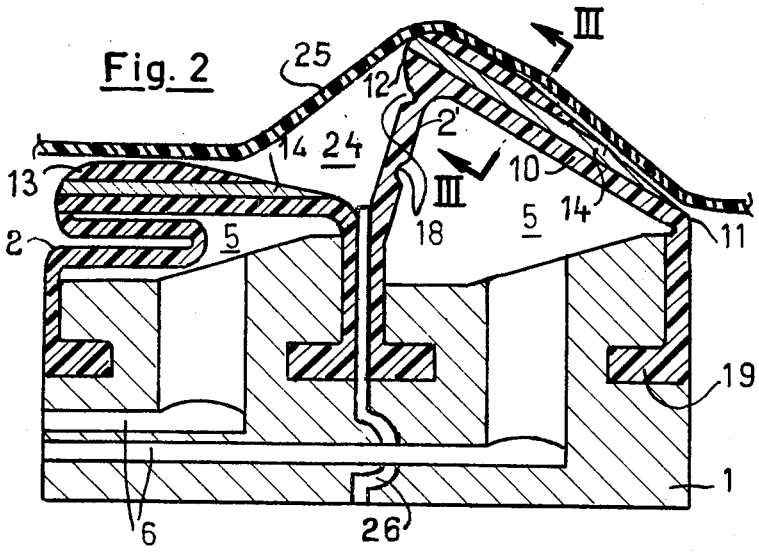
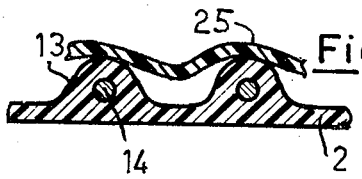
Fig.3

VII

PATH OF CONVEYANCE WITH MEMBRANE

BACKGROUND OF THE INVENTION

The invention relates to a conveying path or way provided with a membrane for conveying a material to be transported over a longitudinal section of the conveying path towards a discharge end of the said path, the said membrane demarcating from the material being transported a pressure medium chamber which is situated at the bottom of the conveying path, extends transversely relatively to the direction of conveying, and is adapted to have a pressure medium admitted into it.

This kind of conveying path can be for example a conveyor channel or a drum of a centrifuge in which a sludge or slurry is transported towards a discharge end.

Such membranes are known for example from the German Laid-Open-Specification No. 2,157,900. They are arranged following one another over the length of the shell of a centrifuge drum, each of them over a section of the length of the path of travel over which the material is to be transported from the drum. According to one particular system the annular-construction pressure medium chambers which are arranged on the shell of the drum and extend transversely to the direction of conveying are acted upon by a pressure medium so that the membranes are bulged towards the interior of the drum, that is to say towards the material being transported. The slurry deposited in the drum on the walls of the membranes slides along the walls which are bulged at the time in question and is intended to be transported in this way in succession in the direction towards the discharge end of the drum.

SUMMARY OF THE INVENTION

The invention has as its object to arrange the membrane in such a manner that when it is bulged towards the material being transported the largest possible quantity of material lying on the membrane is transported in the direction towards the discharge end of the conveying path.

This object is achieved in the case of a membrane of the type initially described according to the present invention in that, as viewed in a longitudinal section through the conveying path, the membrane comprises two portions, of which the first portion which is situated nearer the discharge end of the path extends over a length which amounts to more than half the length of the longitudinal section of the conveying path is reinforced in the longitudinal direction, and the second portion is left flexible, and that edge of the stiffened first portion which is situated relatively near the discharge end of the path is also of flexible construction, and that at least the second, flexible portion of the membrane is briged by means of a covering skin.

Because of this arrangement provided by the present invention, when the pressure medium chamber is subjected to full pressure the membrane is in the form, as viewed in longitudinal section through the conveying path, of a triangle which projects towards the material being conveyed and at whose reinforced wall directed towards the discharge end substantially the entire quantity of deposited material is moved on to the next membrane in the direction towards the discharge end along the surface of the reinforced portion which is inclined towards the bottom.

The covering skin bridging at least the portion of the membrane which has been left flexible allows the membrane to return completely into the flat position when the pressure medium chamber has the minimum pressure in it. The reason being that the skin prevents accumlation of the material or liquid being transported between the folds of the flexible portion which form when the membrane returns to its flat position.

The reinforcing or stiffening of the first portion of the membrane is obtained by giving the reinforced portion, as viewed in a longitudinal section of the conveying path, a thickened construction relatively to the second portion which is left flexible, advantageously in such a manner that, as viewed in longitudinal section through the conveying path, the first reinforced portion comprises a longitudinal ridge-like thickening and a plurality of such thickenings follow one another transversely to the direction of conveying, or else advantageously in such a manner that, as viewed in longitudinal section through the conveying path, the first reinforced portion comprises a rigid insert which extends in the longitudinal direction and which is made of a more rigid material than the membrane, and a plurality of such inserts follow one another transversely to the direction of conveying.

The return of the membrane into the flat position is assisted if the rigid insert in the first reinforced portion is made of a heavier material than the membrane.

The inserts can be connected with the membrane so as to adhere thereto.

According to a preferred constructional form of the invention, the other portion of the membrane is made capable of folding towards the pressure medium chamber, for which purpose, as viewed in longitudinal section through the conveying path, the second portion of the membrane comprises narrowings which define the folding-over points.

In order to give the membrane a preload, it is advantageous if the membrane is produced in a form which corresponds to a membrane position between its position when the pressure medium chamber is subjected to full pressure internally and the position when the pressure medium chamber has the minimum pressure within it.

According to a preferred constructional form, the entire membrane is covered by means of a covering skin. In the case of a conveying path having two or more membranes arranged on the bottom of the conveying path, preferably one covering skin covers two or more membranes.

BRIEF DESCRIPTION OF THE DRAWING

The subject of the invention is described in detail and explained further with reference to the drawings wherein:

FIG. 1 shows a centrifuge drum in longitudinal section,

FIG. 2 shows a fragment from FIG. 1 on a larger scale,

FIG. 3 shows a section taken on the line III—III of FIG. 2,

DESCRIPTION OF THE PREFERRED EMBODIMENTS

Figure 4:
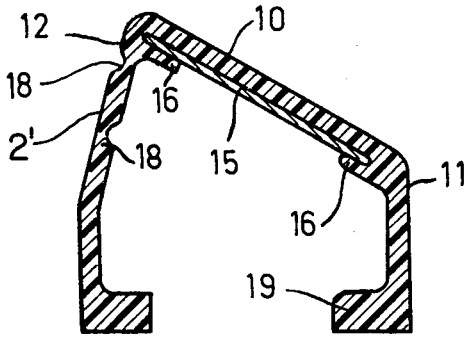
FIG. 4 and FIG. 5 show fragmentary views in accordance with FIG. 2 through further constructional examples of the membrane.

In FIG. 1 the illustrated conveying path is a centrifuge drum 1 from which —in the direction towards a discharge end 4— a slurry 3 (indicated by means of dots) lying on the drum shell or on a covering skin 25 is transported by means of annular membranes 2 which are arranged in succession to one another in the longitudinal direction of the drum.

Each individual membrane 2 is intended to convey the slurry 3 over a length section L in the direction towards a discharge end 4 for the slurry 3. The membranes 2 each define a pressure medium chamber 5 this chamber being provided at the shell of the drum 1 and extending transversely relatively to the direction which the material being transported, that is to say the slurry 3, is conveyed.

Each pressure medium chamber 5 is adapted to be acted upon by means of a pressure medium which flows through ducts 6 provided in the wall of the drum 1. Each duct 6 is connected with a certain number of pressure medium chambers 5.

By applying pressure to the pressure medium chamber 5 the membrane defining the pressure medium chamber 5 moves towards the material being conveyed, that is to say towards the interior of the drum, into a fully actuated position which is shown as 7 in the drawings. When the pressure in the pressure medium chamber 5 is relaxed, the membrane moves from the position shown at 7 under the pressure of the material centrifuged in the drum 1 back into a second flat position corresponding to minimum internal pressure, which position is designated as 8.

During movement of the membrane into the fully pressurised position 7, under the influence of centrifugal forces the slurry 3 deposited at or on the membrane or at or on the covering skin 25 slides towards the next membrane adjacent it in the direction towards the discharge end 4, the said next membrane being situated at that time in the minimum-pressure position designated as 8 in the drawings. In a further phase the last-mentioned membrane is moved into its fully actuated position. In this way the slurry is transported in succession towards the discharge end 4.

As viewed in a longitudinal section through the conveying path, each membrane has two portions. The first portion 10 situated relatively near the discharge end 4 of the conveying path, that is to say the drum 1, is stiffened over a length amounting to more than half the length of the length portion L in the longitudinal direction, i.e. transversely to the direction in which the membrane 2 and pressure medium chamber 5 extend. In the constructional examples shown in FIGS. 2, 4 and 5, the length of the reinforced portion 10 amounts almost to the entire length of the drum length section L.

The second portion 2 of the membrane 2 is left flexible, and thus can fold up. The membrane 2 is also left flexible at that edge 11 of the reinforced portion 10 which is situated relatively near the discharge end 4.

The reinforced portion 10 pivots on a reference line which is situated transversely to the direction of conveying, at the edge 11 situated relatively near the discharge end 4, and forms in the fully actuated position 7 of the membrane 2 a conical surface 9 inclined towards the discharge end 4.

The reinforcing of the portion designated as 10 is usually achieved by the thickening of the portion 10 relatively to the other portion 2 of the membrane 2 which is left flexible.

The thickening can be made from a material similar to the rest of the material of the membrane 2, or other materials may be used for this purpose and can be connected in various per se known ways to the membrane.

As FIG. 2 and FIG. 3 show more particularly, a membrane according to the invention as viewed in a longitudinal section through the conveying path, can comprise a ridge-like thickening 13 which extends in the longitudinal direction of the reinforced portion 10, and at the periphery of the membrane 2, in other words transversely relatively to the direction of conveying, a plurality of such thickenings 13 are arranged in succession to one another. The ridge-like thickenings 13 each comprise a rigid insert 14 which extends in the longitudinal direction and which is made of a more rigid or heavier material (for example steel or lead) than the membrane 2. These inserts 14 are vulcanised into the membrane, in other words adhere thereto.

The mass of the insert assists the return of the membrane into the flat position corresponding to minimum internal pressure. This could also be usefully assisted by a vacuum in the pressure medium chamber 5.

It would be possible to obtain this kind of reinforcing by simple ridge-like thickening extending in the longitudinal direction, and this entire thickening, of a suitable mass, would be made of the same material as the membrane. The thickened portions 13 could also be arranged otherwise than shown in FIG. 3, for example projecting towards the pressure medium chamber 5.

The membrane shown in FIG. 4 comprises a rigid insert 15 which is held relatively to the membrane only by means of projections 16; in other words, the insert 15 is not connected to the membrane so as to adhere thereto. This kind of insert 15 could also be constructed as a rigid plate as well as a rigid bar.

Figure 5:
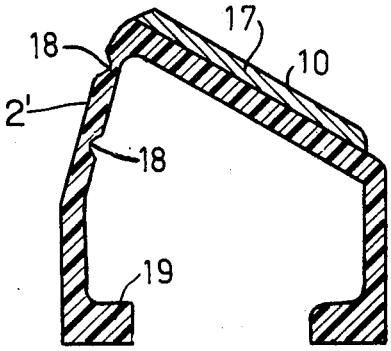

In the case of the membrane shown in FIG. 5 the first, reinforced portion 10 comprises a rib 17 which is vulcanised on to the portion 10, that is to say is connected with the membrane so as to adhere thereto.

In all the illustrated preferred constructional examples the second portion 2 of the membrane, which is left flexible, is made capable of folding towards the pressure medium chamber 5, as is shown in the left-hand half of FIG. 2.

For this purpose the second, flexible portion 2 as viewed in a longitudinal section through the conveying path, comprises narrowings 18 which determine the points of inflection of the folding of the second portion towards the pressure medium chamber 5.

The projections 19 are used for securing the membrane 2 in the shell of the drum 1.

During the swinging of the membrane 2 from a position 7 corresponding to full internal pressure into the other, minimum-pressure position 8, the material of the membrane 2 is subjected variously to tensile stress by variations of the periphery, in the peripheral direction. Therefore it is advisable to give the membrane a certain amount of preload for the two end positions 7 and 8 when the membrane is being manufactured. For example this can be obtained by producing the membrane in a form which corresponds to a position between its position 7 when the pressure medium chamber 5 is subjected to full pressure and its flat position 8 when the pressure medium chamber 5 is subjected to minimum internal pressure.

The illustrated membrane needs not always be of annular construction, that is to say in the form of a closed ring.

The membrane could be arranged along a helical line on the shell of a centrifuge drum, or it could be arranged divided into ring-like sections in a drum, both lines being made substantially annular so to speak.

At the least the second, flexible portion 2 of the membrane 2 is briged with a covering skin 25. Thus there is formed between the membrane 2 and the covering skin 25 a space 24 which is divided off from the material being transported. As a result the membrane 2 can carry out the movements described hereinbefore from the full internal pressure position to the minimum internal pressure position without the conveyed material accumulating on the folding flexible portion 2 and thus possibly preventing the return of the membrane into the flat position corresponding to minimum internal pressure.

The covering skin 25 could be connected at one side to that edge 12 of the first portion 10 which is remote from the discharge end 4, and arranged over the flexible second portion 2 of the membrane 2, could be connected at the other side to the bottom of the conveying path, for example between two adjacent membranes, or it could also be connected with the adjoining portion of a neighbouring membrane.

In this way the covering skin 25 would bridge only the flexible second portion 2 of the membrane.

In the constructions shown in FIG. 1 and FIG. 2 the conveying path, the centrifuge drum 1, comprises a plurality of membranes 2 situated one behind the other in the direction of conveying. All the membranes are covered with one covering skin 25. The covering skin 25 covers each individual membrane and bridges in each case the flexible portion 2 of each membrane too.

The covering skin 25 is annular or in the form of a cylindrical shell and connected at both ends to the centrifuge drum 1. From the space 24 which is formed between the covering skin 25 and the membrane 2, a duct 26 leads through the bottom that is to say through the centrifuge drum 1 in an outward direction and is connected with the atmosphere.

It would also be possible to subject the space 24 to a pressure or a vacuum through this duct 26.

The cylindrical shell covering skin 25 has a diameter which corresponds to the diameter of the annular membrane in the flat position with the pressure medium chamber 5 subjected to minimum pressure, for example the membrane 8 in FIG. 1.

The covering skin 25 is made from an elastically stretchable, fluid-tight material. To prevent friction between the covering skin 25 and the moving membrane 2 a lubricant is situated between them.

A further field of use for the membrane with the covering skin may also be a conveying path used as a conveyor channel, for example with a U-shaped profile.

Figure 6:
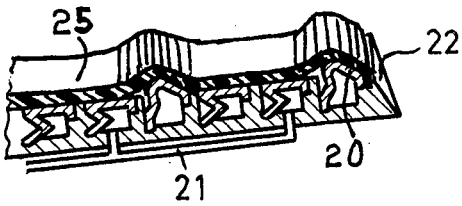
FIG. 6 shows a conveyor channel in longitudinal section.
Figure 7:
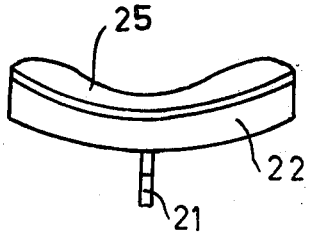
FIG. 7 shows a view taken in the direction of the arrow VII in FIG. 6.

FIG. 6 and FIG. 7 show an end portion of a conveyor channel of this kind. The conveyor channel is inclined relatively to the horizontal. 20 designates the membranes, 21 conduits leading to the pressure medium chamber, and 22 an end wall of the conveyor channel.

I claim :

1. Apparatus including means defining a path of conveyance having a discharge end and along which material is transported, a pressure medium chamber located at the bottom of said path and extending transversely relatively to the direction of transport, and a membrane which covers the chamber and is arched by the pressure therein to thereby transport overlying material along a longitudinal section of said path, and characterized in that a. said membrane comprises two portions having different flexibilities arranged in succession in the direction of conveyance, b. the first portion being located downstream of the second, having a dimension in the direction of conveyance greater than one-half the length of said longitudinal section, being reinforced longitudinally so that it is relatively stiff, and having a flexible region at its downstream edge, c. the second portion being flexible compared to the first portion; and d. the apparatus includes a covering skin which bridges at least the flexible second portion of the membrane and thereby isolates same from the material being transported.

2. Apparatus as defined in claim 1 in which said first portion of the membrane is thicker than said second portion.

3. Apparatus as defined in claim 1 in which said first portion of the membrane includes a plurality of thickened ridges which extend in the direction of transport and are spaced from each other in the transverse direction by thinner membrane sections.

4. Apparatus as defined in claim 1 in which said first portion of the membrane includes a plurality of transversely spaced elongated inserts which extend in the direction of transport and are made of a more rigid material than the membrane itself.

5. Apparatus as defined in claim 4 in which said inserts are made of a heavier material than the membrane itself.

6. Apparatus as defined in claim 4 in which said inserts are adherently connected to the membrane.

7. Apparatus as defined in claim 1 in which said second portion of the membrane is constructed to fold toward the pressure medium chamber.

8. Apparatus as defined in claim 7 in which said second portion of the membrane includes longitudinally spaced sections which are thinner than the balance of said membrane portion and which define points of inflection for folding of said portion.

9. Apparatus as defined in claim 1 wherein the membrane has a flat position which it assumes when the pressure is said chamber is a minimum; and the membrane is so sized that it is stressed both when arched and when in said flat position.

10. Apparatus as defined in claim 1 in which the path of conveyance is a centrifuge drum; and the membrane and covering skin are of annular shape and are arranged inside said drum.

11. Apparatus as defined in claim 10 wherein the membrane has a flat position which it assumes when the pressure in said chamber is a minimum; and the diameter of the covering skin corresponds to the diameter of the membrane when the latter is in said flat position.

12. Apparatus as defined in claim 1 in which the path of conveyance is a conveyor channel; and the membrane is arranged at the bottom of said channel.

13. Apparatus as defined in claim 1 in which the covering skin covers the entire membrane.

14. Apparatus as defined in claim 1 in which there are a plurality of said pressure medium chambers arranged in succession in the direction of conveyance; each chamber is covered by one of said membranes; and said covering skin covers a plurality of said membranes.

15. Apparatus as defined in claim 1 including a duct which leads outside the path of conveyance from the region between the covering skin and the membrane.

16. Apparatus as defined in claim 1 in which the covering skin is made of an elastically stretchable, fluid-tight material.

* * * * *